United States Patent [19]

Newton

[11] 4,345,788

[45] Aug. 24, 1982

[54] PAPER ROLL LIFTING DEVICE

[76] Inventor: Philip T. Newton, 7430 Elliott St., Vancouver, British Columbia, Canada, V5S 2N6

[21] Appl. No.: 217,748

[22] Filed: Dec. 18, 1980

[30] Foreign Application Priority Data

Dec. 19, 1979 [GB] United Kingdom ..... 7943777

[51] Int. Cl.[3] ..... A47F 13/08

[52] U.S. Cl. ..... 294/1 R; 294/67 C; 294/89

[58] Field of Search ..... 294/1 R, 67 C, 89, 93, 294/157, 103 CG, DIG. 2, 74, 76, 67 EA; 414/911

[56] References Cited

U.S. PATENT DOCUMENTS

| | | | |
|---|---|---|---|
| 1,510,564 | 10/1924 | Stockfleth et al. | 294/1 R |
| 3,289,666 | 12/1966 | Prather | 294/1 R |
| 3,626,508 | 12/1971 | Sharrow | 294/89 |

*Primary Examiner*—James B. Marbert

*Attorney, Agent, or Firm*—Hughes, Barnard & Cassidy

[57] ABSTRACT

A light-weight, inexpensive lifting device for facilitating the handling of heavy hollow-cored cylindrical objects such, for example, as the hollow supports commonly used with large rolls of paper and the like, comprising: (i) a thin-wall, pre-shaped cup member adapted to be force-fit into one end of the hollow-cored support and having an outwardly flared radial flange with a diameter greater than the inside diameter of the hollow-cored support for engagement with one end of the support; (ii) a relatively thick metallic washer disposed within the base of the cup member; (iii) a saddle-like clip having parallel leg portions extending through the washer and the base of the cup member for securing such elements together; and (iv), an elongate steel strap or the like characterized by its resilient and self-supporting characteristics and formed into a closed loop having one arcuate loop end passing through the cup member and the washer and engaged with the saddle-like clip, and its opposite arcuate loop end normally projecting slightly beyond the opposite end of the hollow-cored support for engagement with a cargo hook or the like.

10 Claims, 5 Drawing Figures

FIG. 2
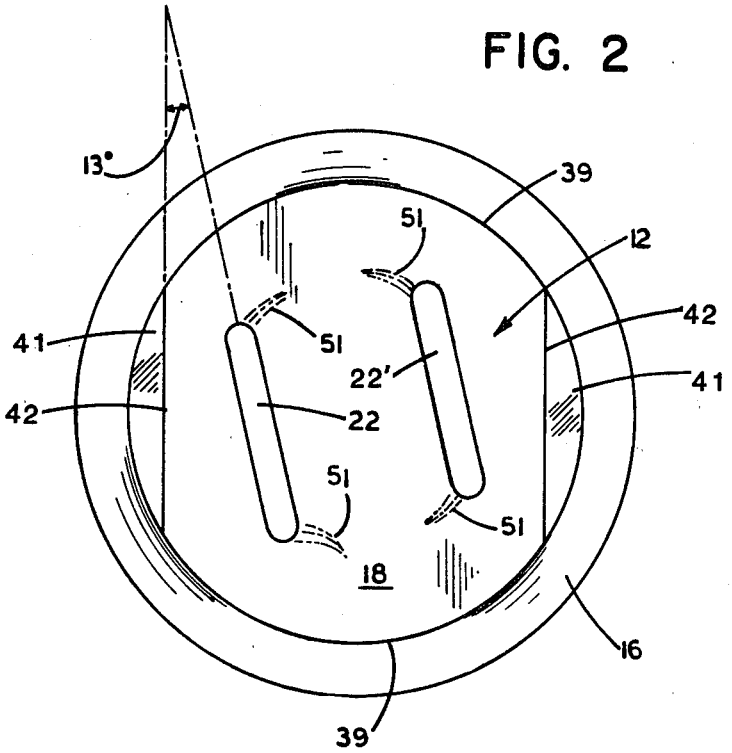
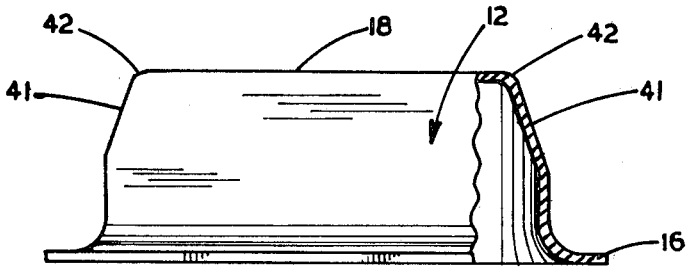
FIG. 3

PAPER ROLL LIFTING DEVICE

BACKGROUND OF THE INVENTION

1. Field of the Invention

The present invention relates to apparatus for facilitating the handling of heavy, hollow-cored cylindrical objects and, more particularly, to apparatus for handling large paper rolls or the like.

2. Prior Art

In the handling and transportation of paper rolls from mill to ultimate customer, such rolls, which normally are far too heavy to permit of manual handling, generally have the paper wound upon heavy cardboard cores which are approximately three inches (3") in diameter. Some of these rolls are on the order of thirty inches (30") in length, while others can be up to five feet (5') in length.

Prior to the advent of the present invention, it has been a common practice when transporting such heavy paper rolls and similar hollow-cored cylindrical objects from a point of origin (such as) a mill to a point of ultimate use (such as a wharf), to employ specially built handling equipment having clamps which permit each roll to be lifted without damage, placed upon a transport vehicle for transportation to a dock, off-loading of the objects from the transport vehicle, and stacking of the objects on the wharf. When loading and/or unloading such objects on and/or from ships or the like, the lifting device employed has generally comprised an expandible probe that is inserted into the core and then expanded against the sides of the core. After the core has been lifted and deposited in the ship's hold, such expanding probes are then collapsed and retracted from the rolls. Unloading from the ship to another wharf is carried out in the same manner. Further transportation, of course, requires additional specially constructed clamping arrangements whereby the rolls can be lifted from the wharf onto transport vehicles or boxcars, and then transported to the ultimate point of use where again special clamping equipment must be used to unload. The conventional method of handling a probe, as above described, requires the use of varied equipment which may, or may not, always be available and which is relatively costly.

Prior to the present invention, relatively expensive, heavy and complex handling devices have been proposed which are purported to permit the lifting device to accompany paper rolls through all or a portion of the travel of the roll from a point of origin to a point of use. A typical device is that disclosed in U.S. Pat. No. 1,510,564-Stockfleth et al. Such devices have not found wide-spread commercial acceptance for a number of reasons. For example, devices of the type described in the aforesaid Stockfleth et al patent are relatively heavy and cumbersome, thereby significantly affecting shipping costs as well as the amount of labor required to position the lifting devices in paper rolls and to later remove such devices from the paper rolls. Because such devices are relatively expensive, they are not suitable for "one-time-usage" applications which permit discarding thereof at the point of destination but, rather, they are commonly returned at considerable expense to the point of origin for subsequent use. Moreover, such devices have commonly incorporated relatively large diameter support flanges which extend under the material wound about the hollow-cored support element, thereby resulting in damage to such materials during handling of the rolls as well as when such rolls are stacked one upon another. Finally, such devices commonly employ rigid, upstanding lifting elements which pass entirely through the hollow-cored support and extend outwardly beyond its upper end for engagement with cargo hooks and the like; and, it has been found that such rigid elements interfere with stacking operations and often cause damage to the paper stored on paper rolls during stacking, loading and/or unloading operations.

SUMMARY OF THE INVENTION

Accordingly, it is a general aim of the present invention to provide an improved paper roll lifting device which overcomes the foregoing disadvantages inherent in conventional prior art lifting equipment and which permits of ease of installation, use and removal.

More particularly, it is an object of the invention to provide a simple, light-weight, and inexpensive lifting device of the foregoing character which is highly effective in use and which essentially eliminates the problem of damage to paper rolls and the like, yet which permits of discarding of such device when the hollow-cored cylindrical object reaches a point of ultimate use.

Briefly-stated, the foregoing objects of the present invention are achieved by providing a thin-walled cylindrical cup having a tight fit in one end of a roll core and having an extending flange for engaging that end of the roll core, such cup being provided with a pair of generally parallel axially extending slots at the base of the cup. A washer of considerably greater thickness than the thickness of the cup fits against the inside of the cup bottom and is provided with a pair of slots which can be rotated into registry with the slots in the cup. The cup and washer are secured in position relative to one another by a saddle-like clip having an arcuate or U-shaped base and generally parallel upstanding legs adapted to be projected through the aligned and registered slots in the washer and cup, with the legs then being crimped over the relatively flat central base portion of the cup. The slots in the cup and the washer are preferably dimensioned to also permit acceptance of a loop of conventional steel strapping or the like of the type normally used for strapping lumber and similar products, which strapping is springy, strong and of sufficient length to insure that when one end of the loop is engaged with the arcuate portion of the saddle-like clip, the other end of the loop normally extends two or three inches beyond the upper end of the core for engagement with a cargo hook or the like.

DESCRIPTION OF THE DRAWINGS

These and other objects and advantages of the present invention will become more readily apparent upon reading the following detailed description and upon reference to the attached drawings, in which:

FIG. 2 is a plan view of a thin-walled cup member which forms part of the lifting device of the present invention and which incorporates features thereof;

FIG. 3 is a side-elevational view of the cup member shown in FIG. 2, here depicting the cup member partly in section and with a portion removed for clarity of illustration;

Figure 1:
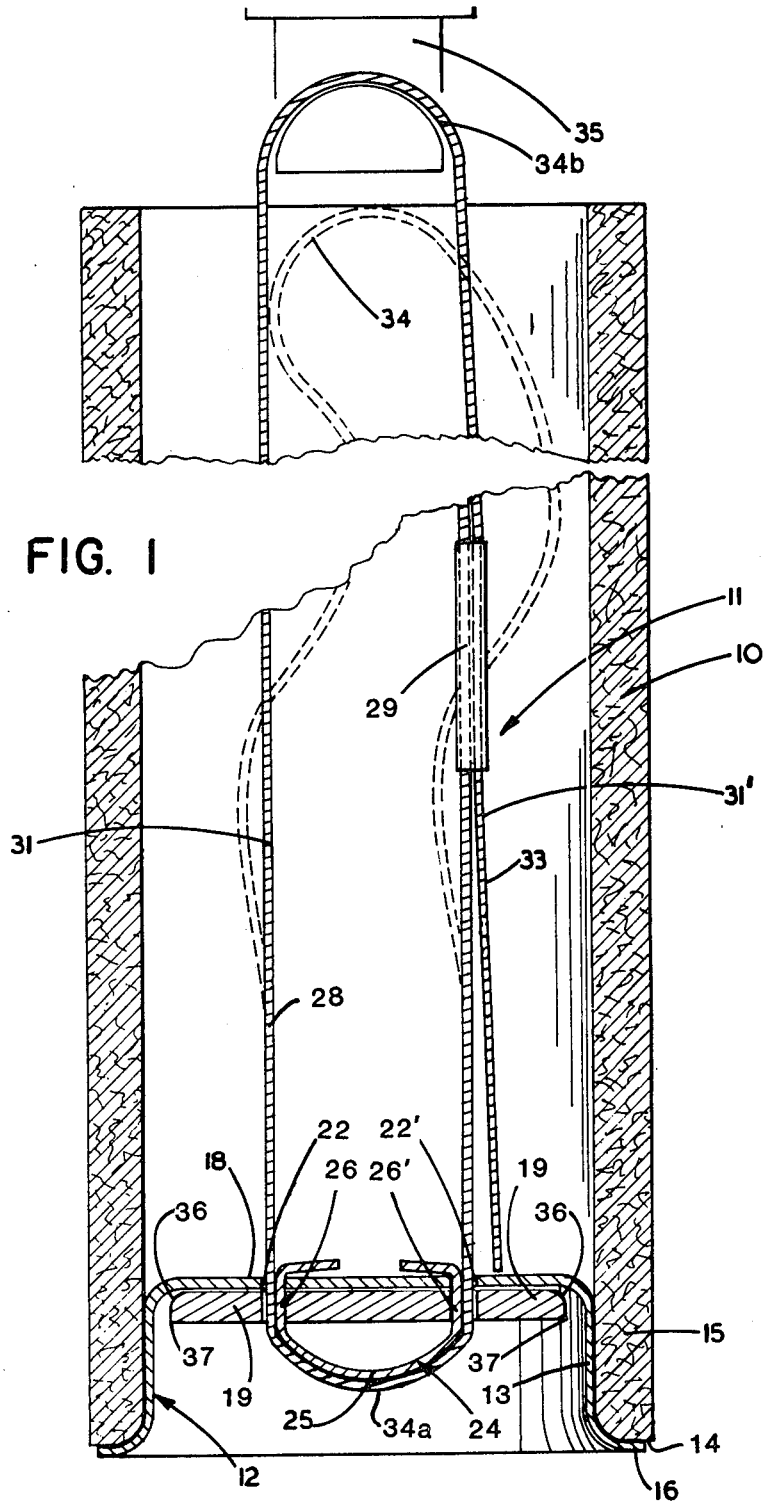
FIG. 1 is a fragmentary vertical sectional view taken through an exemplary hollow-cored roll support with the lifting device of the present invention installed therein.

While the invention is susceptible of various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as expressed in the appended claims.

DETAILED DESCRIPTION

Referring to the drawings, FIG. 1 depicts a conventional cardboard core 10 of the type commonly employed with paper rolls (the paper commonly wound about such a core has not been shown), in which a lifting device, generally indicated at 11, embodying the features of the present invention is installed. The lifting device 11 is provided with a thin-walled metallic cup, generally indicated at 12 (see, also, FIGS. 2 and 3) having an upstanding wall 13 which is substantially cylindrical in shape. The outside diameter of wall 13 is preferably dimensioned to provide a tight force-fit in the lower end portion 15 of the core 10 such that the cup 12 must be driven into place and remains frictionally engaged with the core. The lower end of the cup 12 is provided with a radially-extending flange 16 which is driven tightly against the radial end wall 14 ar the lower end 15 of the core. Preferably, the outside diameter of cup flange 16 is equal to, or slightly less than, the outside diameter of the core 10 so as to preclude direct application of lifting forces to the paper or other sheet material (not shown) wound about the core 10 during a lifting operation.

Figure 4:
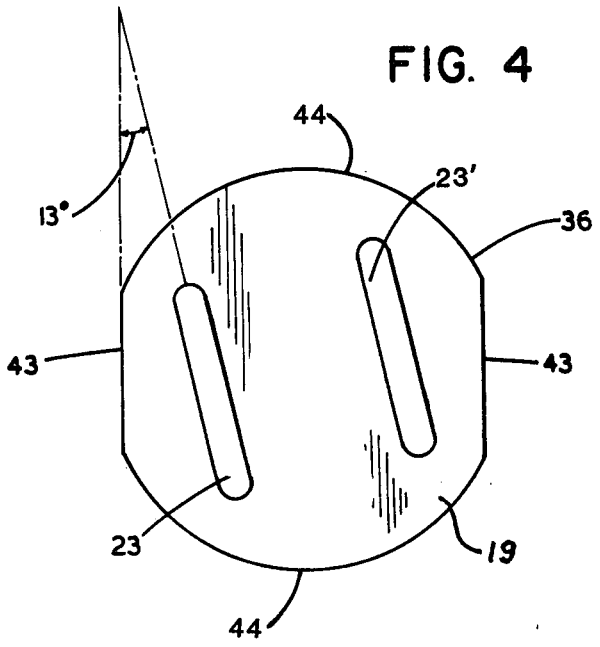
FIG. 4 is a plan view of the washer element used with the present invention; and, FIG. 5 is a side-elevational view of a saddle-like clip with the present invention, here illustrating the clip in solid lines before it is affixed to the cup and washer, and in broken lines after affixing thereof.

Fitting inside the cup 12 against the flat central base portion 18 thereof, is a thick metallic washer 19 which bears against the central base portion 18 of the cup. The diameter of washer 19 is substantially the same as the inside diameter of the cup 12. The central base portion 18 of cup 12 is provided with a pair of elongated parallel openings or slots 22, 22', the lengths of which are sufficient to accept a length of conventional steel strapping of the type that is normally used to bind heavy materials, such as loads of lumber or the like, and which is fairly springly steel material characterized by both its self-supporting characteristics and its resiliency. As best illustrated in FIG. 4, washer 19 is provided with a similar pair of parallel elongated openings or slots 23, 23' for the same purpose as the openings 22, 22' in cup member 12.

Figure 5:
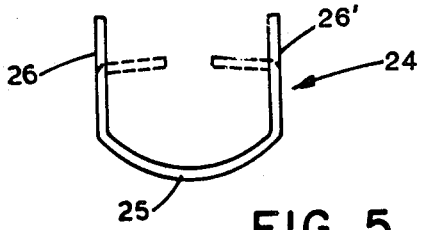

Washer 19 is maintained against the base 18 of the cup 12 by means of a saddle-like clip 24 having an arcuate or U-shaped base 25 and parallel, vertically extending legs 26, 26' which extend through the aligned openings 22, 22' in the cup base 18 and 23, 23' in the washer 19. The vertically extending legs 26, 26' are adapted to be bent over during assembly (as shown in broken outline in FIG. 5 and in solid lines in FIG. 1) for effectively securing the washer 19 and central base portion 18 of the cup member 12 in intimate face-to-face engagement. The width and length of the openings formed in the cup base 18 and washer 19 are sufficient to enable insertion therethrough of not only the legs 26, 26' of saddle-like clip 24 but, also, of a length of conventional steel strapping 28 or the like of the type used to bind heavy loads of lumber and similar objects, such strapping preferably being formed of a springy steel material of considerable strength, but having sufficient resilience to permit deflection thereof into the hollow core 10 in the event that force is applied to the free end of the strapping.

In carrying out this aspect of the invention, and as best illustrated in FIG. 1, the length of steel strapping 28 is shown here formed into a loop with the over-lapping portions of the length of steel strapping being secured together by a friction-type clamp 29. The loop thus formed is defined by generally straight parallel side portions 31, 31' with one tail end portion 33 of the steel strapping kept sufficiently long that it bears against the central base portion 18 of cup member 12, thereby holding the looped steel strap in a fixed position relative to the cup 12 with one looped end **34*a* of the strap 28 in face-to-face engagement with the arcuate or U-shaped portion of the saddle-like clip 24, and its opposite looped end 34*b* normally projecting slightly above the upper end of the core 10 (as shown in solid outline in FIG. 1**).

In practice, when assembling the lifting device 11 of the present invention within the core 10 at the mill site, the workers affixing the strapping 28 to the cup 12 and washer 19 would preferably adjust the steel strapping loop 28 long enough so that when the cup 12 is driven fully into the lower end 15 of the core 10 with the lower strap end **34*a* against the saddle-like clip 24, the opposite end 34*b* of the loop normally extends beyond the opposite end of the core 10 by a distance of two or three inches--viz., a sufficient distance for engagement with a cargo hook (shown diagrammatically at 35 in FIG. 1) for lifting and handling the roll. Once the lifting device 11 of the present invention is assembled within the core 10**, the roll may be handled in this manner from the mill or other point or origin to the ultimate point of use for the roll.

It will be appreciated by those skilled in the art that one advantage of this construction is that a plurality of rolls having the lifting devices of the present invention affixed thereto may be stacked one upon another slightly off center, in which event the upper end **34*b* of the steel loop would be deflected (as shown in broken outline in FIG. 1), allowing the loop 34*b* to withdraw or collapse beneath the top of the roll. The same result would occur where the operator of a forklift truck or the like does not provide sufficient clearance between two rolls being stacked or unstacked in end-to-end relation during a stacking or unstacking operation. When stacked, but slightly offset, rolls are separated, the entire steel loop 28 returns to its normal extended position as shown in solid lines in FIG. 1 with the end 34*b* extending above the core 10 for engagement with a cargo hook 35**.

To ensure that the lifting device 11 of the present invention is sufficiently inexpensive that it can remain with the roll from point of origin to point of destination, and thereafter be discarded, it is preferable that the cup 12 be pressed to shape and that the openings 22, 22' therein be struck out at the same time. Similarly, it is preferable that the washer 19 be die-cut and the openings 23, 23' therein be punched at the same time. As is well known with this type of operation, particularly a punching operation, one peripheral edge 36 (FIG. 1) of the washer 19 is slightly rounded, while the other peripheral edge 37 is burred and sharp. Consequently, in order that the load applied by the washer 19 to the base 18 of cup 12 shall not cause the washer to cut into or damage the cup base 18, it is essential that the rounded edge 36 of the washer face the cup base 18. To insure proper positioning of the washer 19 with respect to the cup 12, and as best illustrated in FIGS. 2 and 3, the cylindrical wall 13 of the cup 12 is preferably formed with a pair of diametrically opposed flats 41 which provide the cup 12 with an out-of-round appearance having two diametrically opposed flat edges 42 and two diametrically opposed rounded edges 39.

Referring to FIG. 4, it will be noted that the washer 19 is die-cut with diametrically opposed flats 43 and diametrically opposed circular portions 44 which are complementary to the flat edges 42 and rounded edges 39, respectively, of the cup 12. As shown in FIG. 2, the flat edges 42 of the cup 12 are angularly disposed relative to the slots 22, 22' formed in the base portion 18 with such angle in the exemplary case being on the order of 13°. As shown in FIG. 4, the flat edges 43 of the washer 19 are also angularly disposed relative to the slots 23, 23' by the same amount. This insures that in order to align the openings in both the washer 19 and the base 18 of cup member 12, the washer can only be fitted into the cup in one direction--viz., with the rounded peripheral edge 36 of the washer 19 flush against the cup base. The provision of the saddle-like clip 24 also insures that the bottom loop 34*a* of the steel strapping 28 does not contact the sharp edges of the openings 23, 23' in the washer 19, and also prevents sharp overbending of the wire strapping loop 28 to reduce stress concentration.

One of the advantages of the washer 19 also resides in the fact that due to its thickness, the base 18 of the cup member 12 will not tear under load conditions (as shown in broken outline at 51 in FIG. 2), as would be the case if stress were applied directly to the base of the cup; but, rather the washer 19 serves to spread the load to the peripheral edges of the cup so as to again reduce stress concentration and thus allow the cup to be made of thin metallic material..

What is claimed is:

1. A lifting device for facilitating handling of relatively heavy rolls of sheet material wound about a cylindrical hollow-cored support and similar hollow-cored cylindrical objects comprising, in combination:

(a) a cup-shaped member having a relatively flat central base portion, an upstanding cylindrical wall, and an outwardly extending radial flange at the free end of said wall; said wall having an outer diameter at least equal to the inside diameter of the hollow-cored support such that said cup-shaped member is frictionally engaged with the hollow-core support upon force-fit insertion of said cup-shaped member into one end of the hollow-cored support with said radial flange in face-to-face engagement with the radial end wall of the hollow-cored support; said central base portion of said cup-shaped member having a pair of spaced openings extending axially therethrough;

(b) a relatively thick metallic washer positioned within said cup-shaped member in face-to-face engagement with said flat central base portion; said washer having a pair of spaced openings extending axially therethrough and positioned for registration with the pair of openings formed in said central base portion of said cup-shaped member;

(c) a generally U-shaped saddle-like clip having an arcuate base portion and a pair of upstanding generally parallel legs; said clip being dimensioned so as to permit said legs to be projected upwardly through respective ones of the registered pairs of openings in said washer and said central base portion of said cup-shaped member with the portions of said legs extending beyond said flat central base portion being folded inwardly into face-to-face engagement with said flat central base portion for securing said washer and said flat central base portion together in face-to-face relation; and, (d) a closed-loop lifting strap formed of resilient springy material characterized by its self-supporting characteristics; said strap having a pair of opposed arcuate loop ends and a pair of generally parallel loop sides and being dimensioned so that said pair of parallel loop sides respectively extend through the pairs of registered openings in said washer and said flat central base portion of said cup-shaped member so as to permit one of said opposed arcuate loop ends of said strap to engage said arcuate base portion of said saddle-like clip in face-to-face relation and the opposed one of said arcuate loop ends of said strap to protect outwardly beyond the opposite end of the hollow-cored support so as to permit selective engagement thereof with cargo hooks and the like.

2. A lifting device as set forth in claim 1 wherein said cup-shaped member is formed of thin-wall metal.

3. A lifting device as set forth in claim 1 wherein said closed loop lifting strap is formed of steel strapping material.

4. A lifting device as set forth in claim 3 wherein said closed loop lifting strap includes a downwardly extending free end adapted to engage the surface of said flat central base portion of said cup-shaped member for positioning and retaining said strap with one of said arcuate loop ends in face-to-face engagement with said arcuate base portion of said saddle-like clip and with the opposite one of said arcuate loop ends normally projecting beyond the end of the hollow-cored support remote from the end into which said cup-shaped member is force-fit.

5. A lifting device as set forth in claim 1 wherein said upstanding cylindrical wall of said cup-shaped member and said washer are each provided with at least one complementary chordal flat edge so as to insure proper registration of the pairs of openings extending axially therethrough upon positioning of said washer within said cup-shaped member.

6. A lifting device as set forth in claim 5 wherein said upstanding cylindrical wall of said cup-shaped member and said washer are each provided with a pair of complementary chordal flat edges so as to insure proper registration of the pairs of openings extending axially therethrough upon positioning of said washer within said cup-shaped member.

7. A lifting device as set forth in claim 5 wherein the outer peripheral edge of the face of said washer engaged with said flat central portion of said cup-shaped member is rounded so as to prevent damage to said cup-shaped member upon application of lifting forces to said washer.

8. A lifting device as set forth in claim 7 wherein said pair of openings extending axially through each of said washer and said flat central base portion of said cup-shaped member comprise pairs of elongate slots formed in respective ones of said washer and said cup-shaped member with said slots oriented at an angle with respect to said complementary chordal flat edges so as to insure that upon registration of said pairs of openings in said washer and said flat central base portion, said washer is positioned with the face thereof having said rounded outer peripheral edge in engagement with said flat central base portion of said cup-shaped member.

9. A lifting device as set forth in claim 6 wherein the outer peripheral edge of the face of said washer engaged with said flat central portion of said cup-shaped member is rounded so as to prevent damage to said cup-shaped member upon application of lifting forces to said washer.

10. A lifting device as set forth in claim 9 wherein said pair of openings extending axially through each of said washer and said flat central base portion of said cup-shaped member comprise pairs of elongate slots formed in respective ones of said washer and said cup-shaped member with said slots oriented at an angle with respect to said complementary chordal flat edges to as to insure that upon registration of said pairs of openings in said washer and said flat central base portion, said washer is positioned with the face thereof having said rounded outer peripheral edge in engagement with said flat central base portion of said cup-shaped member.

* * * * *